US005575342A

United States Patent [19]

Hedlund et al.

[11] Patent Number: 5,575,342

[45] Date of Patent: Nov. 19, 1996

[54] PERCUSSION DRILL BIT, AN INSERT FOR USE THEREIN AND A METHOD OF DRILLING A BORE

[75] Inventors: Jan-Gunnar Hedlund; Bengt Åsberg, both of Houston, Tex.

[73] Assignee: Sandvik AB, Sandviken, Sweden

[21] Appl. No.: 452,136

[22] Filed: May 26, 1995

[51] Int. Cl.[6] ..... E21B 10/46

[52] U.S. Cl. ..... 175/57; 175/420.2

[58] Field of Search ..... 175/415, 420.1, 175/420.2, 426, 434

[56] References Cited

U.S. PATENT DOCUMENTS

| | | | |
|---|---|---|---|
| 3,185,228 | 5/1965 | Kelly, Jr. | 175/415 |
| 4,765,419 | 8/1988 | Scholz et al. | 175/415 |
| 5,113,954 | 5/1992 | Hayashi et al. | 175/296 X |
| 5,335,738 | 8/1994 | Waldenström et al. | 175/420.2 |
| 5,456,329 | 10/1995 | Dennis et al. | 175/420.2 |

*Primary Examiner*—William P. Neuder

*Attorney, Agent, or Firm*—Burns, Doane, Swecker & Mathis, L.L.P.

[57] ABSTRACT

A percussion drill bit for drilling bores, comprises a drill body having a plurality of gauge row inserts embedded in a front end of the drill body. Each gauge row insert comprises a cemented carbide body having a mounting portion embedded in the drill body, and a front end protruding from the drill body. A polycrystalline diamond layer is provided on the front end of the carbide body. The diamond layer has a rear edge disposed in the vicinity of a maximum diameter of the insert. That rear edge is spaced from the wall of the bore during drilling by tilting the gauge row insert at an acute angle of 41° to 51° relative to the rotational axis of the drill bit. The front end of the carbide body is defined by a radius whose origin lies on a center axis of the insert. That origin is disposed axially rearwardly of a plane containing the rear edge of the diamond layer. The length of that radius is 50% to 52% of a diameter of the mounting portion of the insert.

10 Claims, 2 Drawing Sheets

FIG. 2
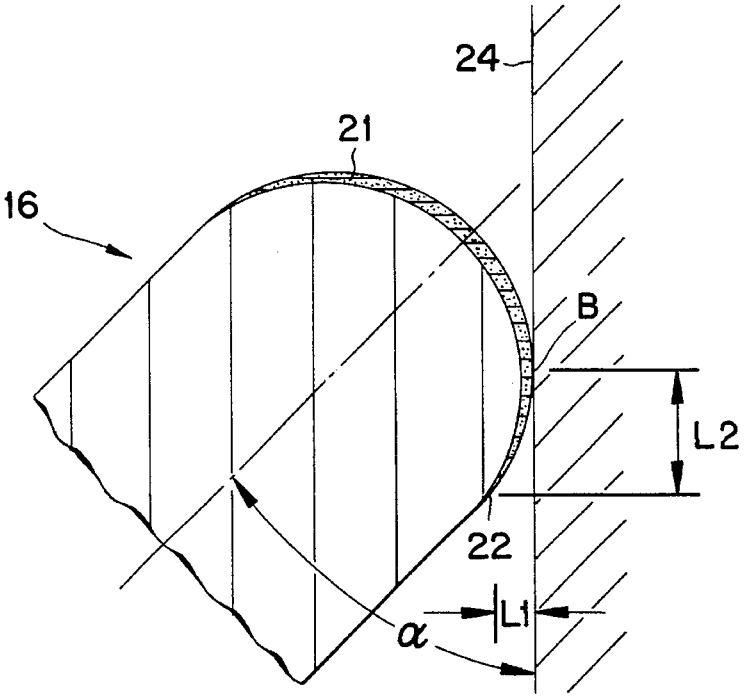
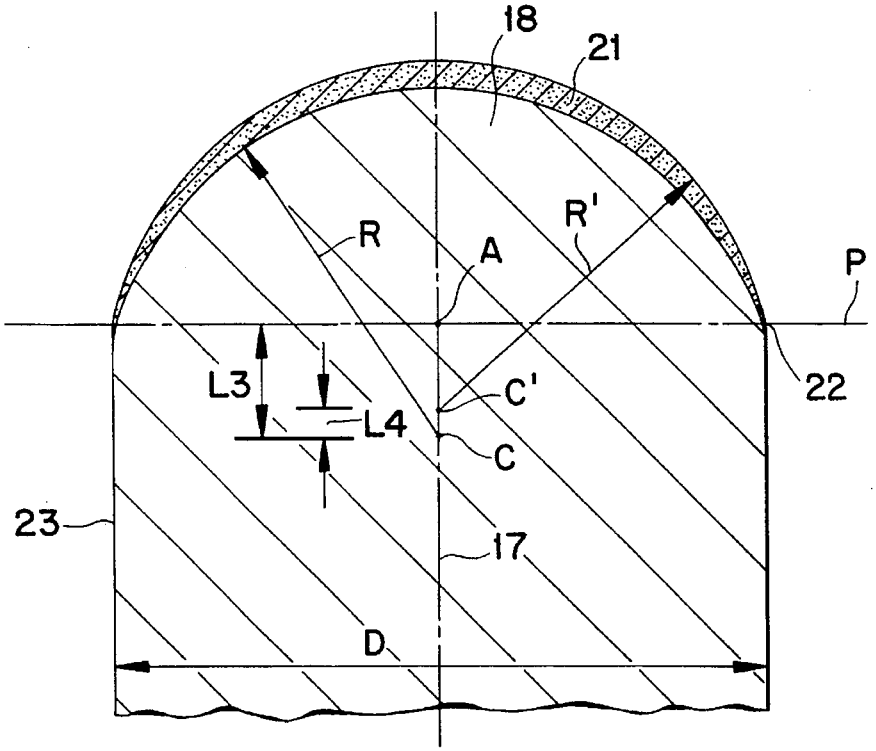
FIG. 3

PERCUSSION DRILL BIT, AN INSERT FOR USE THEREIN AND A METHOD OF DRILLING A BORE

TECHNICAL BACKGROUND

The present invention relates to a percussion drill bit for drilling bores in rock. A typical percussion drill bit comprises a steel drill body, means at one end of the drill body for connecting the bit to a percussive unit such as a down-the-hole hammer or a drill string for a jack hammer, and a plurality of inserts embedded in the other end of the drill body.

At least the peripherally located inserts, or gauge row inserts, comprise a cemented carbide body having a rear mounting portion embedded in the drill body and a front end protruding from the drill body. A polycrystalline diamond layer is provided on the converging end of the carbide body, the layer having an end edge disposed in the vicinity of the maximum diameter of the insert.

Known drill bits that are provided with diamond-coated gauge inserts often have a disadvantage in that premature failures occur due to fatigue of the diamond-coating. A reason for the failure is that the point of contact between the wall of the bore and the gauge insert is close to, or on, the rear edge area of the diamond coating. The coating is very thin at that area and thus has a comparatively poor resistance to wear. The known drill bits more or less drill the bore diameter with the thinnest part of the gauge insert since their gauge inserts are inclined by about 35° relative to the center line of the drill bit.

OBJECTS OF THE INVENTION

An object of the present invention is to provide a drill bit for percussive drilling, wherein the life of the bit is extended.

Another object of the present invention is to provide a drill bit for percussive drilling, wherein the gauge inserts are angled relative to the rotational axis of the bit to keep the edge of the diamond-coating away from the wall of the bore during drilling.

Still another object of the present invention is to provide a drill bit for percussive drilling, wherein each gauge insert has a diamond-coating, the thickness of which varies and wherein a portion of the diamond coating thicker than the edge determines the diameter of the bore.

Still another object of the present invention is to provide an effective gauge insert for a drill bit for percussive drilling.

Still another object of the present invention is to disclose an effective use of a gauge insert for a drill bit for percussive drilling.

SUMMARY OF THE INVENTION

These and other objects of the invention have been attained by a percussion drill bit comprising a drill body having a connecting section at one end thereof for connection to a percussive unit. A plurality of inserts is embedded in the other end of the drill body, wherein at least some of the inserts constitute gauge row inserts each comprising a cemented carbide body having a rear mounting portion embedded in the drill body and a front end protruding from the drill body. A diamond layer is disposed on the front end of the carbide body, that layer having a rear edge disposed in the vicinity of a maximum diameter of the insert. Each gauge row insert is oriented at an acute angle relative to a rotational axis of the drill bit, the angle being from about 41° to about 51° for keeping the rear edge of the insert spaced by a first distance from a wall of the bore during drilling.

The present invention also relates to the gauge row insert itself, i.e., a diamond-coated cemented carbide insert for use as a gauge row insert, and also to a method of drilling a bore.

DESCRIPTION OF THE DRAWINGS

The objects and advantages of the invention will become apparent from the following detailed description of a preferred embodiment thereof in connection with the accompanying drawing in which like numerals designate like elements, and in which:

FIG. 2 shows a sectional view of a gauge insert according to the present invention, in relation to a bore wall; and FIG. 3 shows a gauge insert according to the present invention in longitudinal section.

DETAILED DESCRIPTION OF A PREFERRED EMBODIMENT OF THE INVENTION

Figure 1:
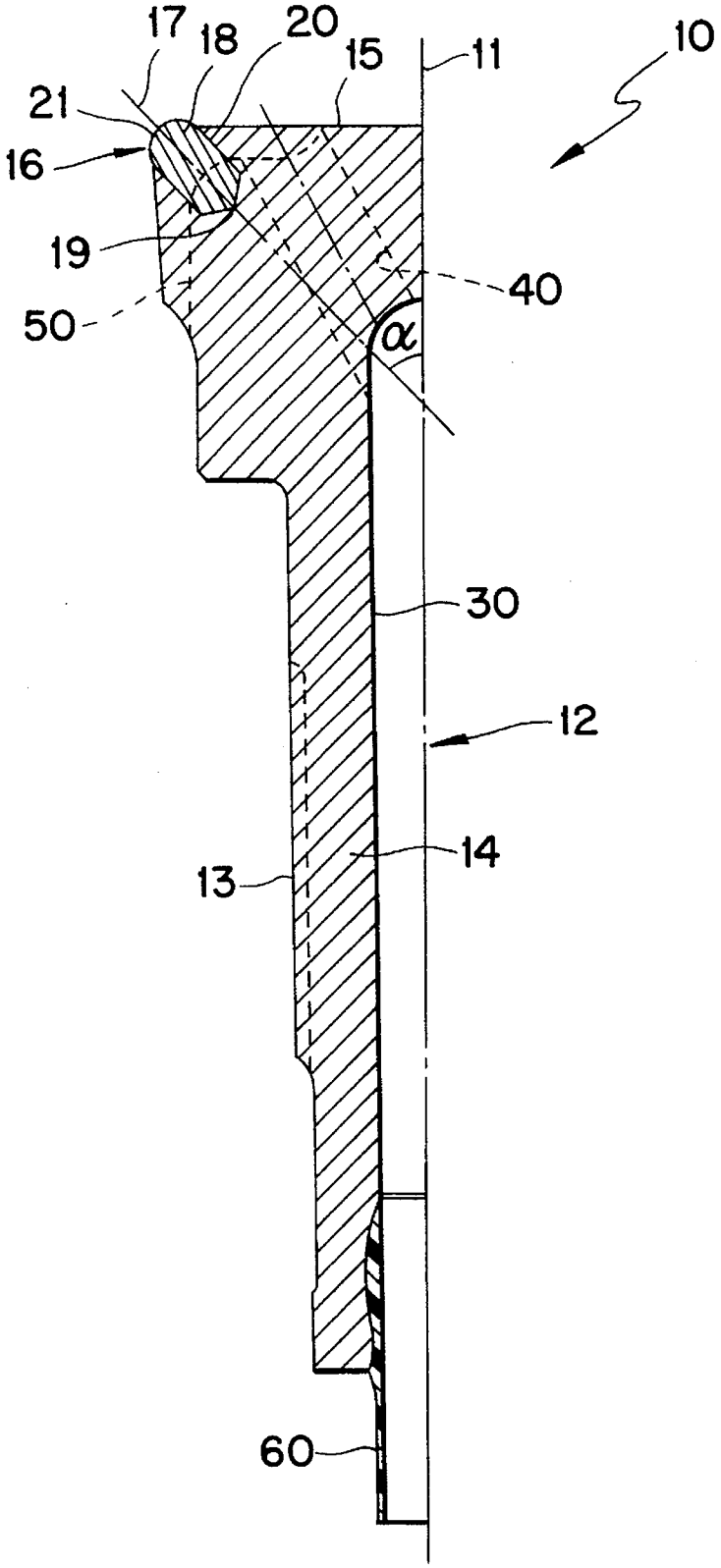
FIG. 1 shows one half of a drill bit according to the present invention in longitudinal-section.

In FIG. 1 there is shown one longitudinal half of a drill bit 10 according to the present invention, the bit being generally symmetrical about its rotational axis 11. The bit comprises a steel drill body 12 which has external splines 13 on a shank 14 thereof. The splines shall be connected to corresponding splines formed in a driver sub of a down-the-hole hammer, not shown, so as to transfer rotational movement in the usual manner. Alternatively the splines could be replaced by other means, such as threads, for connecting the bit to a drill string, not shown.

The drill bit 10 further includes a central passage 30 for a pressurized medium such as air, connected to an angled fluid passage 40 which is further connected to a chipway or return groove 50. A conventional plastic valve 60 is disposed in the passage 30.

Provided in a front face 15 of the drill body is a number of button inserts (not shown). The button inserts are made of cemented carbide and secured in borings preferably by press fit.

A number of gauge row inserts 16 is positioned at the periphery of the bit 10, the radially outer portions of which define the diameter of the bit and thus the diameter of the bore being drilled.

The gauge row inserts 16 are tilted in such a way, that a longitudinal center line (center axis) 17 of each insert 16 diverges by an angle $\alpha$ from the longitudinal center axis 11 of the drill bit in a forward direction of the bit. The tilting of the gauge row insert can also be expressed in such a way that the point where the longitudinal center line 17 of the insert 16 intersects the front cutting end 18 of the insert is located farther from the longitudinal center line 11 of the drill bit than the point where the longitudinal center line 17 intersects the rear end 19 of the insert.

Several gauge row inserts 16 may be embedded in the front end of the drill body 12. Each insert 16 comprises a cemented carbide body having a cylindrical grip or mounting portion 20 embedded in the drill body and a front converging end protruding from the drill body. A polycrystalline diamond layer 21 is provided on the converging end of the carbide body to define the cutting end 18 of the insert. The layer 21 has a rear edge 22 substantially lying in a plane P, see FIGS. 2 and 3, the plane P preferably forming an acute angle with the center line 11, that angle being equal to the above-mentioned angle α. The edge 22 is disposed on the cylindrical jacket surface 25 of the insert at or in the vicinity of the maximum diameter of the insert, preferably at a junction between a curved front surface of the carbide body, and the cylindrical jacket surface 25. The longitudinal center line 11 of the drill bit and the longitudinal center line 17 of the inserts 16 include the angle α therebetween. The angle α is in the range of about 41°–55°, in order to space the edge 22 by a distance L1 from the wall of the bore during drilling. More preferably, the angle α is about 41° to 51° and most preferably is about 45°. The distance L1 is at least 1.5 mm. For example the distance L1 is preferably about 1.7 mm for an insert diameter D of 18 mm.

The cemented carbide portion of the cutting end 18 is semi-spherically curved and defined by a radius R lying on the center axis 17, and the origin C of the radius R is positioned axially rearwardly of the plane P. The plane P intersects the center axis 17 at a point A. The distance L3 between the point A and the radius origin C is 5 to 30%, preferably about 20%, of the radius R. The radius R is 50 to 52% of the diameter D of the grip portion 20, preferably 50 to 51%.

During drilling, the point of contact B, see FIG. 2, between the wall of the bore and the insert 16 is axially displaced by a distance L2 from the edge 22. The distance L2 is 50 to 70% of the radius R, preferably about 60% for an insert diameter D of about 18 mm.

The diamond layer 21 has an outer surface defined by a radius R' of the same magnitude as radius R, the origin of which radius R' lying on the center axis 17 and displaced axially forwardly by a distance L4 relative to the origin C of radius R. The size of the distance L4 is less than 1 mm but larger than 0.1 mm, preferably about 0.6 mm. Thus the thickness of the layer varies from 0.1 mm at the edge to 1 mm at its intersection with the center line 17 (most preferably from 0.2 mm at the edge to 0.8 mm at the center line). The diamond layer 21 comprises polycrystalline diamond (PCD) preferably with a binder content between 1 and 15%.

Since the new inventive drill bit will drill longer than hitherto known drill bits it is favorable if the drill body, at least in the vicinity of and around the gauge row inserts, is provided with a wear resistant coating, such as a hard metal coating. The thickness of such a coating is preferably about 0.1 mm. That avoids steel wash-out and thereby prevents the gauge row inserts from losing steel support and falling off the drill body.

The present invention further relates to a method of maintaining the diameter of a drill bit during percussive drilling of a bore in a rock material. The method comprises the following steps: providing a drill bit having the geometry described above, connecting the bit to a percussive unit and drilling a bore, while spacing the rear edge of the diamond layers of the gauge inserts from the wall of the bore during drilling so as to maximize the duration of the life of the bit.

The present invention further relates to the use of a diamond-coated cemented carbide insert as a gauge row insert in a drill bit for percussive drilling.

The invention can be varied freely within the scope of the appended claims. For example the shape of the cutting end of the insert can be semi-spherical or bullet-shaped.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A percussion drill bit for drilling a bore, comprising a drill body having a connecting section at a rear end thereof for connection to a percussive unit and defining a rotational axis of the drill bit, and a plurality of gauge row inserts embedded in a front end of the drill body, the front end being rigid with respect to the connecting section, each gauge row insert comprising a cemented carbide body having a rear mounting portion embedded in the drill body, and a front end protruding from the drill body, there being a diamond layer disposed on the front end of the carbide body, the layer having a rear edge disposed adjacent a maximum cross section of the insert, the gauge row inserts oriented at an acute angle relative to the rotational axis of the drill bit, the angle being from about 41° to about 51° for spacing the rear edge of the diamond layer from a wall of the bore during drilling.

2. A drill bit according to claim 1, wherein the front end of the carbide body is curved and defined by a radius, an origin of the radius being disposed axially rearwardly of a plane containing the rear edge of the diamond layer.

3. A drill bit according to claim 2, wherein the radius of the front end is 50 to 52% of a diameter of the rear mounting portion, with a maximum diameter of the rear mounting portion being 18 mm.

4. A drill bit according to claim 3, wherein the radius is 50 to 51% of the diameter of the rear mounting portion.

5. A drill bit according to claim 3, wherein the rear edge of the diamond layer is spaced by a distance of at least 1.5 mm from the bore wall during drilling.

6. A drill bit according to claim 4, wherein the distance is about 1.7 mm.

7. A drill bit according to claim 1, wherein a point of contact between the wall of the bore and the insert is displaced axially forwardly from the rear edge of the diamond layer.

8. A drill bit according to claim 7, wherein the front end of the carbide body is curved and defined by a radius, the axial displacement of the point of contact from the rear edge of the diamond layer being about 50% to 70% of the radius, with a maximum diameter of the insert being about 18 mm.

9. A drill bit according to claim 8, wherein the axial displacement is 60% of the radius.

10. A method of drilling a bore in a rock material, the method comprising the steps of:

A) providing a percussive drill body having a connecting section defining a rotational axis, and a plurality of gauge row inserts embedded in a front end of the body, the front end being rigid with the connection section, each gauge row insert comprising a cemented carbide body having a rear mounting portion embedded in the drill body and a front end protruding from the drill body, a diamond layer disposed on the front end of the carbide body, the layer having a rear edge disposed in the vicinity of a maximum diameter of the insert;

B) rotating the drill body about the rotational axis such that the gauge row inserts define a diameter of a bore being drilled, and C) spacing the rear edge of the layer from a wall of the bore during drilling by tilting the gauge row inserts at an acute angle of about 41° to about 51° relative to the rotational axis.

* * * * *